United States Patent [19]

Beauchet et al.

[11] 3,972,148

[45] Aug. 3, 1976

[54] MACHINE TOOL FOR FINISH-GRINDING THE INNER SURFACES OF ANNULAR WORKPIECES

[75] Inventors: Jean Beauchet, Veyrier du Lac; Gerard Druge, Cran Gevrier, both of France

[73] Assignee: Societe Nouvelle de Roulements, Annecy, France

[22] Filed: Mar. 19, 1975

[21] Appl. No.: 559,741

[30] Foreign Application Priority Data

Apr. 8, 1974 France ..... 74.12305

[52] U.S. Cl. ..... 51/5 D; 51/94 R; 51/105 R; 51/215 UE

[51] Int. Cl.[2] ..... B24B 5/10; B24B 41/02

[58] Field of Search ..... 51/5 D, 30 R, 94 R, 51/97 R, 105 R, 215 H, 215 UE, 234, 290, 291

[56] References Cited

UNITED STATES PATENTS

| | | | |
|---|---|---|---|
| 2,144,095 | 1/1939 | Zwick | 51/105 R X |
| 2,356,499 | 8/1944 | Beduneau | 51/105 R |
| 2,401,165 | 5/1946 | Knapp | 51/50 R |
| 2,442,683 | 6/1945 | Green | 51/50 R |
| 2,575,228 | 11/1951 | Moore | 51/5 D |
| 3,751,857 | 8/1973 | Price et al. | 51/215 H |
| 3,852,920 | 12/1974 | Takida et al. | 51/105 R |

*Primary Examiner*—Al Lawrence Smith
*Assistant Examiner*—Nicholas P. Godici
*Attorney, Agent, or Firm*—Brumbaugh, Graves, Donohue & Raymond

[57] ABSTRACT

An internal finish-grinding machine of the type comprising a frame carrying a rotatable grinding wheel and also supporting an axially movable table which itself carries a rotatable support for a workpiece has the table pivotally mounted on a single horizontal spindle which also forms a guide rail along which the table is axially movable. The spindle extends over a major part of the length of the grinder to give the table widely based support and the spindle is situated in a substantially vertical plane containing the axis of rotation of the workpiece support. The spindle is mounted in the lower part of the machine frame in order to maximize the distance between the axis of the spindle and the axis of rotation of the workpiece support. This ensures that there is a minimum deviation in the shape of the finish-ground workpiece brought about by wear of the periphery of the grinding wheel.

1 Claim, 5 Drawing Figures

MACHINE TOOL FOR FINISH-GRINDING THE INNER SURFACES OF ANNULAR WORKPIECES

This invention relates to machine tools for finish-grinding the internal surfaces of annular workpieces, such as the outer bearing rings of ball or roller bearings, cylindrical bores and the like. Finish-grinding is precision grinding to the required final dimensions.

Internal finish-grinding machines usually have two supporting tables, one for the workpiece and the other for the grinding wheel, each adjustable in position in two mutually perpendicular directions. The movement of the table supporting the grinding wheel allows the grinding wheel to be advanced axially towards the workpiece and then laterally into engagement with the surface of the workpiece. The movement of the table supporting the workpiece allows advancement in a similar manner. This arrangement of the tables makes the machine tool very sensitive to vibrations which arise during grinding operations, and tends to reduce the precision obtained in grinding. The double movements of the two tables involve a very accurate construction of these parts, increasing the cost of construction of the machine as a whole.

Another disadvantage of this conventional type of internal finish-grinding machine is that the machines are constructed to take only one type of grinding wheel spindle, or even only one particular spindle. Consequently if the operator of the machine wishes to change over to a different kind of grinding operation this can involve considerable modification of the machine and of its operating cycle. Further, machines of this conventional type are not equipped with any means for locking the various parts of the machine in position during the grinding operation. These machines are consequently very sensitive to vibrations.

In another existing type of machine tool for internal finish-grinding, the workpiece support is fixed to a rigid base. The support for the grinding wheel, on the other hand, is fixed to a carriage which is movable axially along approximately horizontal guide bars. Lateral advance of the grinding wheel is obtained by pivoting the carriage about one of the guide bars, which functions as a stationary axis.

This known type of machine is an advance on previous finish-grinding machines but the horizontal positioning of the guide bars for the carriage make it necessary to give the machine large overall dimensions in order to reduce the dimensional errors in the finished workpiece arising from the wearing down of the grinding wheel, that is to say in order to reduce the angular amplitude of the swing of the carriage on its stationary guide bar necessary to compensate for the wearing down of the grinding wheel. Furthermore in a machine of this type it is not possible to provide really adequate space for accommodating the devices used for feeding the workpieces to the grinding position and for removing the finished workpieces. The horizontally movable carriage gets in the way.

The aim of the present invention is to overcome these difficulties by providing a machine tool for internal finish-grinding of annular workpieces, cylindrical bores and the like, which is comparatively insensitive to vibration, due to the nature of its construction. A further aim of the invention is to provide such a machine tool which is arranged in such a way that when the grinding wheel becomes worn down this results in unusually little variation in the dimensions of the finished workpiece.

To this end, according to this invention, a machine tool for finish-grinding the inner surfaces of annular workpieces comprises a frame carrying a support for a grinding wheel and also supporting an axially movable table which itself carries a rotatable support for a workpiece, the table being pivoted on a single horizontal spindle which also forms a guide rail which guides the axial movement of the table and extends over a major part of the length of the machine tool, the spindle being situated in a substantially vertical plane containing the axis of rotation of the workpiece support and being mounted in a lower portion of the machine frame so as to maximize the distance between the axis of the spindle and the axis of rotation of the workpiece support.

It is the object of further optional features of the invention to provide a machine tool for internal finish-grinding which is constructed in such a way that it can easily be adapted for performing any one of several different grinding operations, for example for finish-grinding the internal tracks of the outer rings of ball bearings, for finish-grinding cylindrical internal bores of the inner rings of ball and roller bearings of all kinds, and for finish-grinding the conical internal bores of the outer rings of tapered roller bearings. A further object of other preferred features is to provide an internal finish grinder capable of taking a variety of different finish grinding wheels, suitable for different grinding operations, including such new kinds of grinding wheels which are likely to become available in the future as a result of technological developments.

A still further object is to provide an internal finish grinder which is simple in construction and does not involve the use of prismatic guide rails of conventional type, which are costly in construction and require careful maintenance.

In a preferred example of the invention pivoting movement of the table is effected by movement of a wedge-shaped part cooperating with a side face on the table. This pivoting movement is for compensating for wearing down of the grinding wheel.

With a view to suppressing as far as possible all vibrations during the grinding operation, the machine tool is preferably provided with means for thrusting the side face of the table against the wedge-shaped part during a grinding operation. This has the effect of restraining the movements of the parts of the machine during the grinding operation.

Preferably also, the grinding wheel support is movably mounted on a stationary platform and means are provided for adjusting the grinding wheel support in position axially and laterally on the platform. This enables the grinding wheel to be positioned accurately in both directions, before grinding begins, in dependence upon the characteristics of the workpiece.

The grinding wheel support is designed to take a variety of different grinding wheels and can if desired be constructed integrally with a motor for rotating the grinding wheel. Furthermore the grinding wheel support can if desired be equipped with means for reciprocating it axially.

In a preferred example of the invention a sensitive device for advancing the workpiece is fixed to the supporting table, the device having a shoe which is adapted to thrust against the workpiece, the shoe being acted upon by a thrust piston which is controlled by a control piston, a compression chamber being interposed between the two pistons, and means being provided by varying the pressure of air in the chamber.

The preferred example of the invention is also equipped with a device for feeding and delivering the workpieces fixed to the supporting table and situated between the workpiece support and the grinding wheel support, the device comprising a pivoted arm for conveying the workpieces, a feed channel, a delivery channel, and a lever which is actuated directly by a workpiece while it is being fed to the workpiece support by the pivoted arm, the lever ejecting the preceding workpiece from the workpiece support.

The workpiece support may comprise an end-support ring, the workpiece being held against the face of the ring by the axial pull of an electromagnet. The workpiece is then located laterally by two supporting shoes thrusting along different radii at an angle to each other. One of these shoes takes the radial thrust of the grinding wheel. A preferred feeding device is described in detail in the applicant's French Patent Application No. 71-25837.

The machine tool may further comprise a diamond dressing tool for dressing the grinding wheel, the dressing tool being pivoted on a pin fixed to the supporting table and pivoting in a vertical plane situated between the workpiece support and the grinding wheel support, so that the diamond dressing tool is applied to the grinding wheel tangentially. One example of a machine tool according to the invention intended particularly for finish-grinding the tracks of the outer rings of ball bearings, to give the track the desired toroidal cross-section, is equipped with a device for diamond dressing the grinding wheel to the desired toroidal profile.

The preferred diamond dressing device for dressing the grinding wheel on a radius comprises a spindle attached to a support, the spindle being rotatable without play about an axis which is tangential to the grinding wheel, the outer portion of the spindle being connected to the support through a massive C-spring, the inner end of the spindle, closest to the grinding wheel support being connected to the diamond dressing tool through a second massive C-spring.

An example together with two modifications of machine tools for the finish-grinding of the inner surfaces of annular workpieces in accordance with the invention will now be described with reference to the accompanying drawings, in which.

Figure 1:
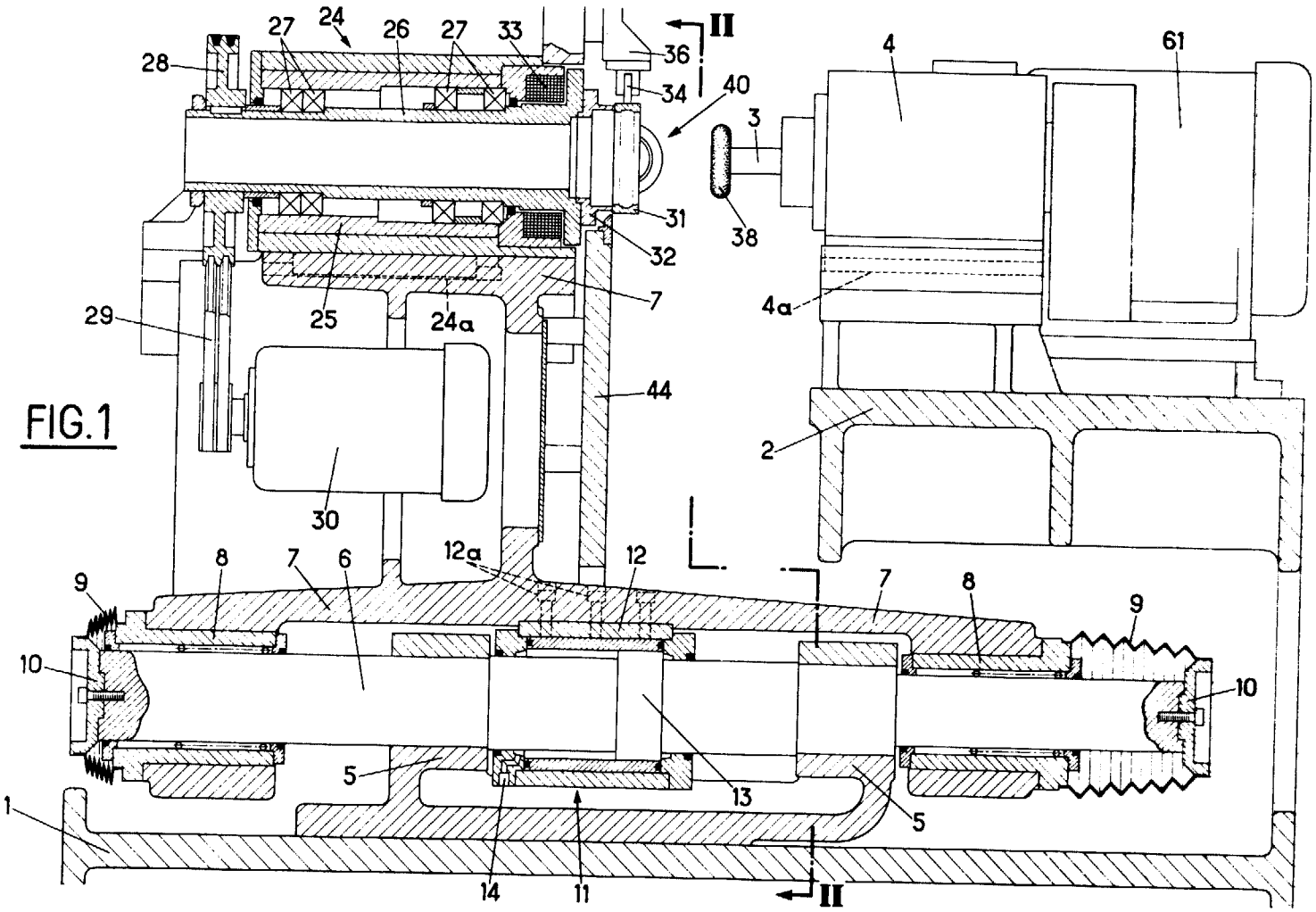
FIG. 1 is a longitudinal section, taken on the plane I—I in FIG. 2, of one example intended in particular for finish-grinding a toroidal internal track in the outer race ring of a ball bearing.
Figure 2:
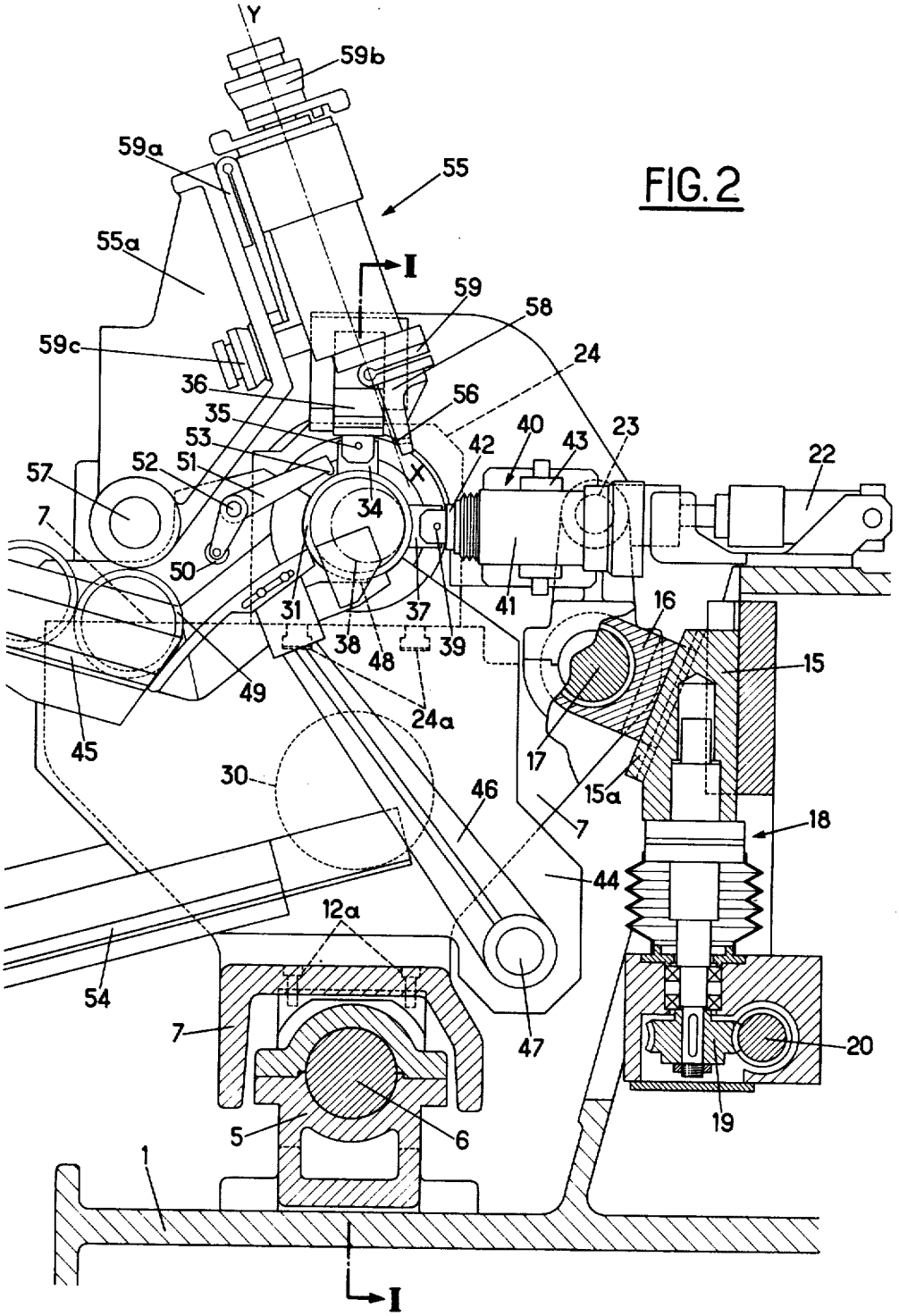
FIG. 2 is a cross-section of the first example taken on the plane II—II of FIG. 1.

With reference to FIGS. 1 and 2, the machine tool shown is suitable for finish-grinding the internal surfaces of outer race rings of ball bearings. The machine comprises a rigid cast-iron frame 1 supporting, at the right as seen in FIG. 1, a large precision-ground platform 2 which itself supports, on an adjustment device 4*a*, a grinding wheel support 4. The adjustment device 4*a* is for adjusting the grinding wheel support 4 precisely in position axially and laterally. A spindle 3 of a precision grinding wheel 38 is rotatably mounted in the support 4.

Fixed to the lower part of the frame 1 there are two bearings 5 supporting a cylindrical guide bar 6 on which a pivoted supporting table 7 slides axially. For this purpose the pivoted supporting table 7 has, in its lower portion, two sleeves 8 mounted on ball bearings which are pre-stressed in compression to eliminate play. The sleeves 8 are spaced apart by a distance which approaches the total length of the machine, so that the pivoted supporting table 7 is itself supported in a very stable manner. The cylindrical guide bar 6 terminates at its two ends in two end pieces 10. Between each sleeve 8 and the end piece 10 there is a protective bellows 9. The pivoted supporting table 7 slides longitudinally on the cylindrical guide bar 6, being movable by a hydraulic cylinder 11 in which a piston 13 slides. The cylinder 11 is contained in a cylinder holder 12 which is bolted by bolts 12*a* to the pivoted supporting table 7. The piston 13 is a collar formed integrally by machining with the cylindrical guide bar 6, near the middle part of the guide bar. The pivoted supporting table 7 slides to and fro in a direction perpendicular to the end face of a workpiece 31. This eliminates machining tolerances due to thermal expansion. A hydraulic connection to the cylinder 11 is shown at 14 in FIG. 1, the other connection being invisible in this section.

In pivoting on the cylindrical guide bar 6 the pivotal movements of the supporting table 7 are controlled by a stop plate 15 (FIG. 2) which has a sloping surface 15*a* to form a wedge which cooperates with a block 16 which itself travels longitudinally on a cylindrical guide bar 17 fixed to the pivoted supporting table 7. Here again pre-stressed ball bearings are used between the block 16 and the bar 17 to eliminate play. The stop plate 15 moves vertically being moved by a ball jack 18 which is actuated by a worm wheel 19 meshing with a worm 20, which is driven by a step-by-step motor 21, shown in FIG. 3.

During the grinding of the workpiece 31, the block 16 is constantly held in firm contact with the sloping surface 15*a* by the action of a hydraulic cylinder 22 the piston of which acts on a cylindrical longitudinal guide bar 23 fixed to the pivoted supporting table 7. This prevents vibrational movement between the block 16 and the sloping surface 15*a*.

The upper portion of the pivoted supporting table 7 supports a workpiece support 24. Fixed to the pivoted supporting table 7 there is a massive housing 25 containing a hollow spindle 26 which rotates in roller bearings 27. The hollow spindle 26 is rotated by a motor 30, fixed to the pivoted supporting table 7 and operating through belts 29 and pulleys 28. Angular adjustment in position of the massive housing 25 is effected by means of an adjustment device 24*a*. Angular adjustment is necessary, before grinding begins, in the first place to ensure that the workpiece support 24 is accurately aligned with the tool support 4 and, in the second place, because it is necessary to compensate for flexure in the grinding wheel spindle 3.

Figure 3:
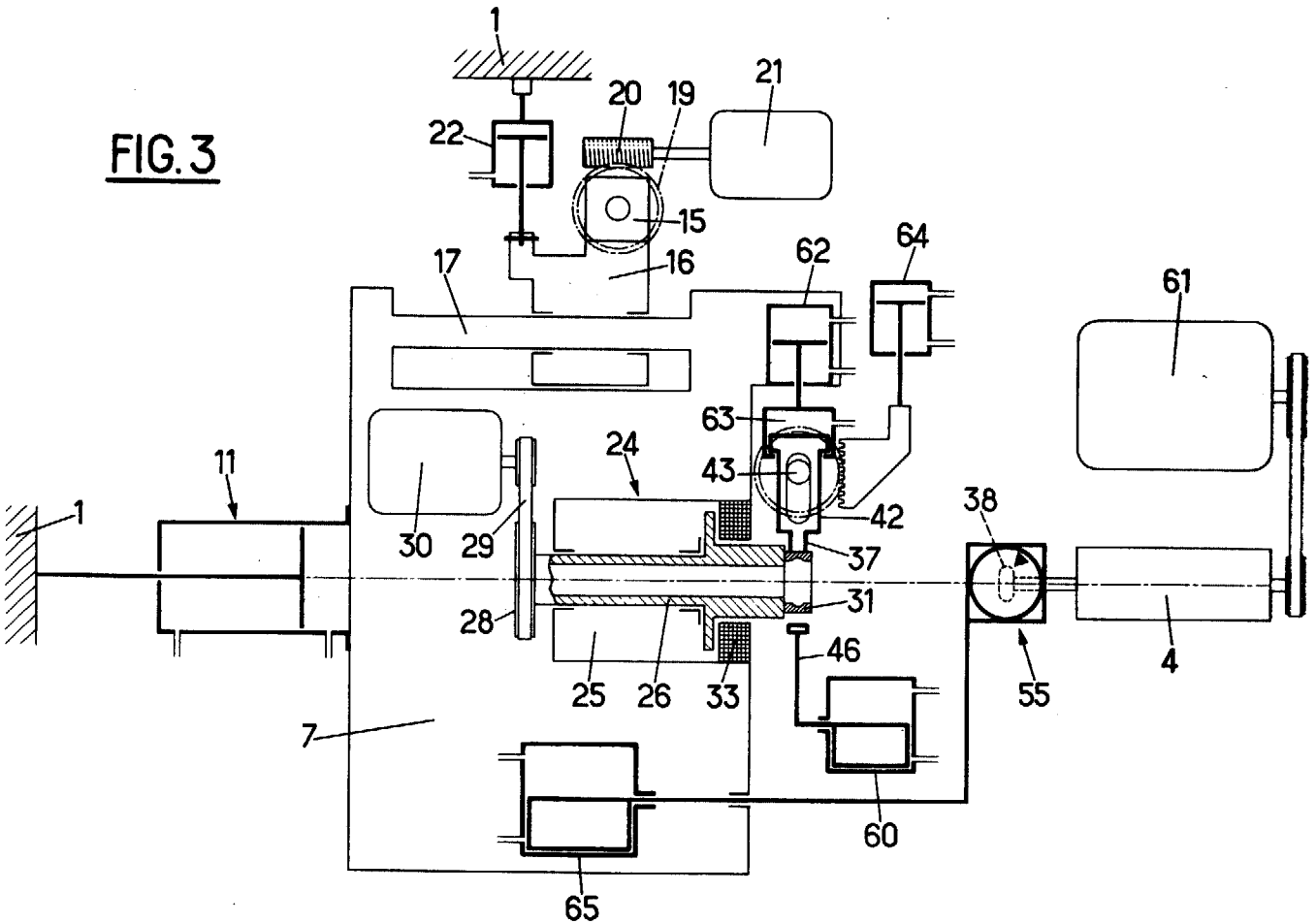
FIG. 3 illustrates diagrammatically the arrangement of the first example as seen in plan view, to show how its various main parts function.

In the example shown in FIGS. 1, 2 and 3 the workpiece 31 is the outer bearing ring of a ball bearing. As shown in FIG. 1, the workpiece 31 is supported by being held in firm contact with an end-support ring 32 by the pull of an electromagnetic coil 33 fixed to the massive housing 25. The workpiece 31 is therefore given "centreless" support. The workpiece 31 is also supported vertically by a shoe 34 which is pivoted on a pin 35 (FIG. 2) fixed to a stationary bracket 36. The workpiece 31 is also supported laterally by a further shoe 37, situated at 90° relative to the shoe 34 in the opposite direction to the direction of linear lateral advance of the grinding wheel in contact with the workpiece. The lateral support shoe 37 is pivotally mounted on a pin 39 fixed to a pneumatic workpiece-advance controller 40. With regard to the pneumatic workpiece-advance controller 40, it should be observed that any kind of device can be used for thrusting the lateral support shoe 37 against the workpiece. Nevertheless what is preferred is the device described in the applicant's French Patent Application No. 71-46832. That is a sensitive device for advancing the workpiece laterally and consists essentially of a cylinder 41 in which a thrust piston 42 slides. The piston 42 is equipped with a lateral thrust shoe 37 and cooperates with a control piston (not shown). Between the thrust piston and the control piston there is a chamber containing a cushion of compressed air, which acts between the two pistons. The pressure in the chamber is controlled by conventional means so that when the grinding wheel 38 first makes contact with the workpiece 31 the pressure is comparatively low. This is to protect the surface of the grinding wheel, that is to say to preserve its profile, at the time when the workpiece still has a rough surface. The pressure in the air cushion is then increased progressively, up to the pressure required in the grinding process proper.

The pneumatic workpiece-advance controller 40 contains a senser (not shown) for sensing the position of the lateral thrust shoe 37. The senser controls the working cycle and triggers retraction of the thrust piston 42 at the end of the grinding process. The senser can for example make contact with an eccentric stop 43 which moves in a slot 44, shown in FIG. 3. The eccentric stop 43 is rotated to give a sinusoidal rate of advance, in particular so that the lateral advance of the workpiece decreases and then ceases for long enough to allow the grinding wheel to give the surface of the workpiece a planished finish. The planishing continues until no more sparks appear. At that point the mechanical parts are no longer under strain, having by now reached their true positions of rest.

In an alternative mode of operation the eccentric stop 43 can trigger retraction of the grinding wheel. This also allows the strained mechanical parts to return to their true positions of rest.

The hollow spindle 26 can if desired contain a senser (not shown) capable of advancing into the interior of the workpiece, for accurately measuring the bore.

The example of the machine shown in the drawings is preferably equipped with a feeding and delivering arrangement of the kind described in the applicant's French Patent No. 71-25837. This arrangement is shown in FIG. 2. A vertical plate 44 is fixed to the pivoted supporting table 7. The workpieces are fed to the machine by an inclined feed channel 45. A feeder arm 46 pivots on a stationary pin 47 and has on its end a V-notch feeder fork 48. The feeder arm feeds a subsequent bearing ring 49 to be found from the inclined feed channel 45 into a position in front of the magnetic end-support 32, which is then energised by the coil 33.

When the grinding has been completed, the coil 33 is de-energised and the feeder arm 46 then lifts a further workpiece into position in contact with the magnetic end-support ring 32. In this movement the fresh workpiece ring 49 actuates a roller 50, causing an ejector lever 51 to rock a pivot pin 52. The other end 53 of the lever 51 ejects the finished workpiece ring 31 into a delivery channel 54. The machine cycle is then repeated.

The machine represented in FIGS. 1 and 2 is intended for finish-grinding the internal track of an outer bearing ring 31 of a ball bearing and for this purpose the machine uses a grinding wheel 38 having a toroidal peripheral surface. For dressing the grinding wheel 38 to the desired radius, the machine is equipped with a diamond radius dresser 55 mounted on a support **55*a* which pivots on a pin 57 fixed to the pivoted supporting table 7. The diamond radius dresser 55 is engaged, after retraction of the workpiece support 24 into the position shown in FIG. 1, simply by pivoting the support 55*a* to bring the diamond into position in contact with the grinding wheel 38. The arrangement allows a short-grinding wheel spindle 3 to be used and ensures that the diamond 56** approaches the grinding wheel tangentially. The diamond dressing operation is highly precise, due to the precise action of the stops.

The diamond radius dresser shown in FIGS. 1 and 2 is described in detail in the French Patent application No. 73-25270. This preferred arrangement comprises a spindle which rotates without play on an axis X-Y which is tangential to the grinding wheel 38 during the diamond dressing operation. The external portion of the spindle is attached to the support **55*a* through a massive C-spring 59*a*. At its lower end the spindle has a diamond holder 58 attached to the spindle through a further massive C-spring 59. The diamond is shown at 56. Two precision adjustors 59*b* and 59*c*** are arranged to strain the C-springs for correcting the diameter of the race track and for precisely adjusting the radius of the toroidal profile. The arrangement, which involves no play, makes it possible to use a device for automatically correcting the diameter of the grinding wheel, for example, on the basis of the diameter of the race track.

The machine tool represented in FIGS. 1 to 3 is well suited for grinding the track of an outer ring for a ball bearing. The finish-grinding operation can for example be conducted as follows: With reference to FIG. 3, the feeder arm 46 is driven in its pivoting movement by a rotary piston 60. The workpiece 31 is retained in contact with the face of the end-support ring 32 by the influence of the electromagnetic coil 33. The grinding wheel 38 is rotated by a motor 61, the tool support 4 being held stationary on the frame 1 of the machine. The pivoted supporting table 7 advances along the cylindrical guide bar 6, driven by the hydraulic cylinder 11, which is represented diagrammatically on the left in FIG. 3. The workpiece 31, rotated by the hollow spindle 26, therefore advances axially towards the grinding wheel 38. The pivoted supporting table 7 advances to the limit of travel of the hydraulic cylinder 11, the end of this movement being damped. A detector (not shown) commands the control piston 62 (FIG. 3) to advance, thrusting, through the compression chamber 63, the thrust piston 42 forwards and so thrusting the lateral shoe 37 against the surface of the workpiece 31. This brings the grinding wheel 38 into contact with the track of the workpiece 31. The pressure in the compression chamber 63 being at first comparatively low, the grinding wheel 38 at first smooths the surface of the workpiece. This continues for a period determined by a timing device. The pressure in the compression chamber 63 is then increased to complete the grinding operation. At the end of the grinding operation the thrust piston 42 makes contact with the eccentric stop 43. Finally, the pressure in the compression chamber 63 can if desired be sustained during the interval of time necessary for planishing the workpiece surface.

It is also possible, in a modified mode of operation, to actuate the control piston 64 which moves the eccentric stop 43, so that the lateral shoe 37 continues to advance in a controlled way before the final planishing. Obviously the working cycle can be varied in a number of ways.

In particular, the workpiece can be advanced towards the grinding wheel by acting on the stop-plate 15 by means of the step-by-step motor 21. In this mode of operation the lateral shoe 37 remains stationary during the whole grinding operation, merely supporting the workpiece in the same way as the vertical shoe 34. At the end of the grinding operation the lateral shoe 37 is retracted to facilitate rapid ejection of the finished workpiece.

After completion of the grinding operation the control piston 62 is retracted and then the piston 64, and the initial pressure is restored in the compression chamber 63. The hydraulic cylinder 11 then travels to the left in FIG. 1, so that the pivoted supporting table 7 retracts the hollow spindle 26 all the way towards the left, whereupon a new cycle of operations can begin for finish-grinding a further workpiece ring. After a certain number of grinding operations have been completed, it becomes necessary to adjust the machine to compensate for wearing down of the grinding wheel 38. For this purpose the pivoted supporting table 7 is retracted all the way to the left. The stop plate 15, with its sloping surface 15*a*, is then raised slightly, causing the pivoted supporting table 7 to pivot enough to compensate for the wear on the grinding wheel 38. The rotary piston 65, shown in FIG. 3, is then actuated and the grinding wheel 38 is radius dressed by the diamond.

In order to finish-grind a ball bearing outer ring containing two tracks it is merely necessary to arrange two rightward limit stops for the pivoted supporting table 7. Alternatively a double grinding wheel 38 can be used on a single spindle 3, in which case it is unnecessary to perform two successive grinding operations. It should be observed that the diamond dressing can be done at any time desired, not necessarily after a certain number of grinding operations have been completed.

In FIG. 2 it will be observed that the pivoted supporting table 7 which supports the workpiece support 24 and pivots on the cylindrical guide bar 6 is positioned approximately vertically. This has the advantage that, the pivoted supporting table being approximately neutrally balanced, the thrust of the block 16 against the sloping surface 15*a* can be adjusted sensitively.

A further advantage of having the pivoted supporting table 7 approximately vertical is that the axis of the workpiece support 24 can be positioned quite high above the axis of the cylindrical guide bar 6. If the pivoted supporting table 7 were arranged horizontally and the workpiece support 24 were situated far away from the cylindrical guide bar 6 the overall dimensions of the machine would have to be much larger.

In a machine such as this which is operated without making measurements on the workpiece, that is to say merely with the help of mechanical stops, it can be demonstrated mathematically that the error produced in the workpiece by the grinding operation and due to pivoting of the pivoted supporting table 7 becomes smaller the greater the distance between the workpiece and the cylindrical guide bar. This is because when the table pivots into a new angular position, due to wearing down of the grinding wheel, this moves the workpiece into a different position relative to the grinding wheel. The vertical positioning of the pivoted supporting table 7 therefore reduces the grinding error resulting from the wearing down of the grinding wheel.

As shown in FIG. 1, the pivoted supporting table 7 is guided in a very stable way due to the fact that its support extends over a major part of the entire length of the machine. This greatly contributes to precision in the grinding operation. A further advantage of the arrangement in accordance with the invention is that the pivoted supporting table leaves plenty of free space underneath the workpiece for accommodating the workpiece feeding and ejecting mechanism and for the various devices which are necessary for supplying lubricants and coolants to the surfaces during the grinding operation.

The tool support 4, directly and rigidly fixed to the machine platform 2, is arranged for easy exchange or replacement of grinding wheels. Furthermore the tool support 4 is designed to accept readily any movements likely to be required with regard to accurate positioning of the axis of the grinding wheel relative to the axis of the workpiece and with regard to electronic control of the movements of various parts of the machine, in compensating for wearing down of the grinding wheel, in controlling workpiece advance, in the making of corrections and the like.

Figure 4:
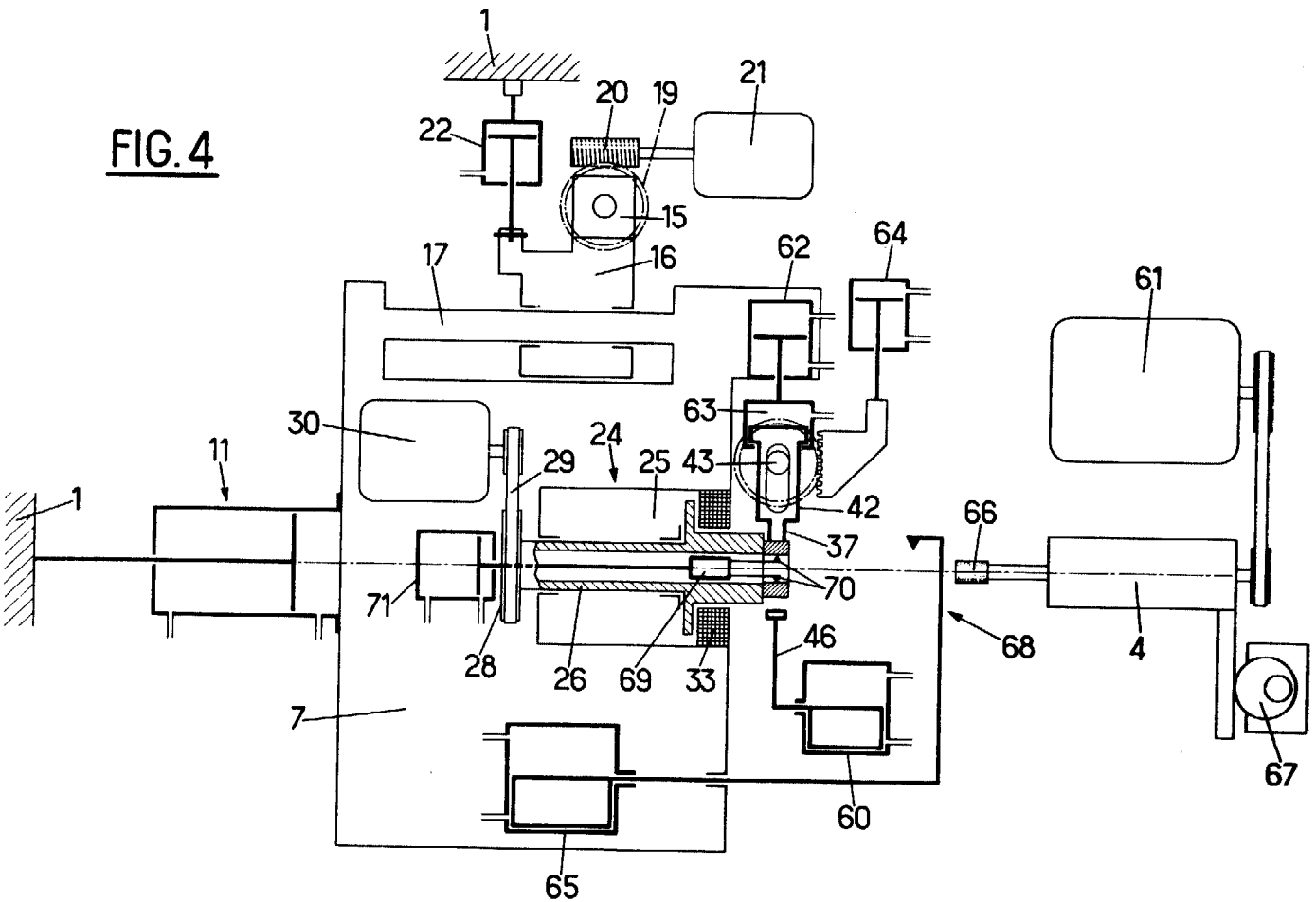
FIG. 4 is a view similar to FIG. 3, but illustrating a modification of the machine tool suitable for finish-grinding an internal cylindrical surface; and, FIG. 5 is another view similar to FIG. 3, but illustrating a further modification of the machine tool for finish-grinding a conical internal surface.

FIG. 4 shows, quite diagrammatically, a finish-grinding machine generally similar to that shown in FIGS. 1 to 3, but modified for finish-grinding a cylindrical inner surface. The machine is essentially the same as the machine shown in FIGS. 1 to 3, but in this case a cylindrical grinding wheel 66 is used and it can be arranged to reciprocate axially with a stroke of a few millimeters. The reciprocating motion is imparted to the grinding wheel 66 by a variable speed motor 67 or the like. The grinding wheel is constantly in contact with the inner surface of the workpiece during the grinding operation. The tool support 4 is arranged, as described above, so that its position can be adjusted axially and transversely to correspond with the dimensions of the workpiece. In this case a diamond with a stationary point is used, as indicated at 68 for dressing the wheel. A measuring device 69 with sensers 70 moves axially back and forth in the hollow spindle 26, driven in its reciprocating motion by a piston in a cylinder 71. The senser measures the ground diameter of the workpiece continually during the whole grinding operation.

Figure 5:
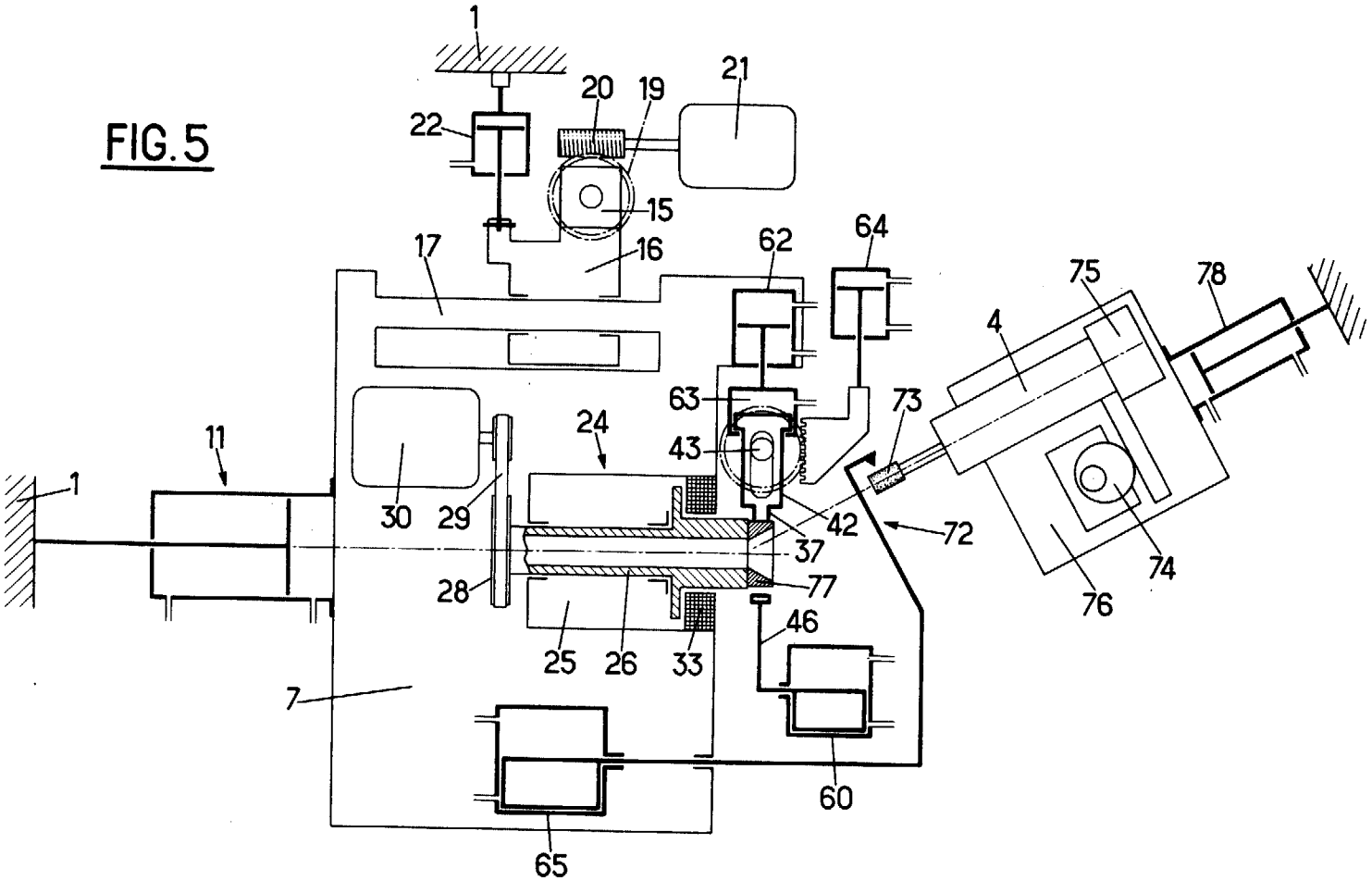

FIG. 5 shows a machine modified for finish-grinding a conical inner surface. A cylindrical grinding wheel 73 reciprocates axially, the reciprocating motion being imparted to it by a variable speed motor 74 with the help of a converter 75. The grinding wheel 73 is dressed by a diamond supported in a rectangular support 72.

In this modification an adjustment device 4*a* fixed rigidly to the platform 2 supports a plate (not shown) which pivots in a horizontal plane for adjusting the angle of the axis of the grinding wheel 73 to correspond with the cone angle of the workpiece ring 77. After adjustment, the plate is locked in position. The plate supports a carriage 76 mounted on ball bearings so that it can move axially, with respect to the grinding wheel 73. A hydraulic cylinder 78 advances the carriage 76 to bring the grinding wheel 73 into engagement with the workpiece 77. The hydraulic cylinder 78 can also be used if necessary for imparting a reciprocating motion to the carriage 76.

The machine tool in accordance with the invention can therefore easily be adapted to perform grinding operations of diverse kinds, using a variety of working cycles. It will be observed that the machines shown in FIGS. 4 and 5 are modified only with regard to the tool support system. The basic machine tool remains unchanged, in particular with regard to the arrangements for advancing the workpiece, for compensating for wearing down of the grinding wheel, the arrangement for supporting the diamond dressing tool and the arrangement for feeding and delivering the workpieces.

Machines in accordance with the present invention can therefore be used in a wide variety of different applications, in particular for finish-grinding a variety of internal profiles, simply by changing the tool support system. The main portion of the machine, that is to say the non-modified portion, is constructed in such a way that vibrations are avoided practically entirely and the influence of grinding wheel wear on the accuracy of the grinding operation is minimized.

We claim:

1. In a machine tool for finish-grinding the inner surfaces of annular workpieces, said machine tool including a frame, a grinding wheel support carried by said frame, a rotatable workpiece support, means for rotating said workpiece support, a table, means movably mounting said workpiece support on said table, and means supporting said table from said frame for movement parallel to the axis of rotation of said rotatable workpiece support, the improvement wherein said means supporting said table from said frame consists of a single horizontal spindle, means fixedly mounting said spindle on said frame at the lowermost portion of said frame, said spindle extending over a major part of the entire length of said frame, and means mounting said table on said spindle for sliding movement therealong and pivotal movement thereabout in a substantially vertical plane, said spindle being situated in another substantially vertical plane containing the axis of rotation of said workpiece support whereby said table is approximately neutrally balanced and, said spindle being mounted in said lowermost portion of said frame, the distance between said spindle and said axis of rotation of said workpiece support is maximized.

2. A machine tool as claimed in claim 1, further comprising a stationary platform, means movably mounting said grinding wheel support on said stationary platform and means for adjusting said grinding wheel support in position axially and laterally of the axis of said wheel on said platform.

3. A machine tool as claimed in claim 1 for finish-grinding conical bores, further comprising a plate, means mounting said grinding wheel support on said plate and means pivotally mounting said plate for pivotal movement in a horizontal plane.

4. A machine tool as claimed in claim 1 for finish-grinding cylindrical or conical bores, further comprising means mounting said grinding wheel support for movement axially of said wheel and means for reciprocating said grinding wheel in said axial direction.

5. A machine tool as claimed in claim 1, further comprising sensitive means for advancing a workpiece held by said workpiece support and means fixing said sensitive means to said table, said sensitive means including a shoe which is adapted to thrust against a workpiece held by said workpiece support, a thrust piston acting on said shoe, a control piston, means defining a compression chamber between said thrust piston and said control piston and means for subjecting said compression chamber to a variable air pressure.

6. A machine tool as claimed in claim 1, further comprising a device for feeding and delivering workpieces to and from said workpiece support, and means mounting said device on said table, said device including a pivoted arm for conveying said workpieces, a feed channel, a delivery channel, a lever located to be actuated by a workpiece being fed along said feed channel to said workpiece support by said pivoted arm and means on said lever for ejecting a preceding workpiece from said workpiece support when said lever is actuated by said workpiece being fed along said feed channel.

7. A machine tool as claimed in claim 1 for finish-grinding internal tracks of outer rings of ball bearings, further comprising a dressing tool support, a dressing tool spindle carrying a dressing tool and means rotatably mounting said dressing tool spindle on said dressing tool support, said means mounting said dressing tool spindle including pre-stressed bearing means mounting said dressing tool spindle without play for rotation about an axis which is tangential to said grinding wheel, a first massive C-spring connecting an outer portion of said dressing tool spindle to said dressing tool support and a second massive C-spring connecting an inner end portion of said dressing tool spindle to said dressing tool.

8. A machine tool for finish-grinding the inner surfaces of annular workpieces, said machine tool including a frame, a grinding wheel support carried by said frame, a rotatable workpiece support, means for rotating said workpiece support, a table, means movably mounting said workpiece support on said table, and means supporting said table from said frame for movement parallel to the axis of rotation of said rotatable workpiece support, wherein said means supporting said table from said frame comprises a single horizontal spindle, means fixedly mounting said spindle on said frame, said spindle extending over a major part of the length of said machine tool, and means mounting said table on said spindle for sliding movement therealong and pivotal movement thereabout, said spindle being situated in a substantially vertical plane containing said axis of rotation of said workpiece support and said spindle being mounted in a lower portion of said frame whereby the distance between said spindle and said axis of rotation of said workpiece support is maximized, means defining a side face on said table, and wedge-shaped means cooperating with said side face for effecting pivoting movement of said table about said spindle, and means for positively thrusting said side face of said table against said wedge-shaped means during operation of said machine tool whereby vibrations of said table are suppressed.

9. In a machine tool for finish-grinding the inner surfaces of annular workpieces, said machine tool including a frame, a grinding wheel support carried by said frame, a rotatable workpiece support, means for rotating said workpiece support, a table, means movably mounting said workpiece support on said table, and means supporting said table from said frame for movement parallel to the axis of rotation of said rotatable workpiece support, the improvement wherein said means supporting said table from said frame comprises a single horizontal spindle, means fixedly mounting said spindle on said frame at the lowermost portion of said frame, said spindle extending over a major part of the entire length of said frame, and means mounting said table on said spindle for sliding movement therealong and pivotal movement thereabout in a substantially vertical plane said spindle being situated in another substantially vertical plane containing the axis of rotation of said workpiece support whereby said table is approximately neutrally balanced and, said spindle being mounted in said lowermost portion of said frame, the distance between said spindle and said axis of rotation of said workpiece support is maximized and further comprising axial moving means for moving said table axially of said spindle, said axial moving means comprising fluid-pressure cylinder means fixed to said table substantially in a vertical plane containing said workpiece and a collar formed integrally on said spindle, said collar being mounted in and slidable relative to said cylinder and forming a piston therein, and said spindle extending substantially parallel to said axis of rotation of said workpiece support.

* * * * *